United States Patent [19]

Bognar et al.

[11] 4,051,756

[45] Oct. 4, 1977

[54] CUTTING ARRANGEMENT

[75] Inventors: Istvan Bognar, Zurich; Peter Brassel, Uster, both of Switzerland

[73] Assignee: Zellweger, Ltd., Switzerland

[21] Appl. No.: 551,105

[22] Filed: Feb. 20, 1975

[30] Foreign Application Priority Data

Feb. 20, 1974 Switzerland ..... 2313/74

[51] Int. Cl.[2] ..... B26D 5/08; B26D 7/02

[52] U.S. Cl. ..... 83/389; 83/587; 57/86; 57/87; 83/382; 83/373; 83/567

[58] Field of Search ..... 83/389, 262, 586, 587, 83/373, 382, 567; 57/86, 87

[56] References Cited

U.S. PATENT DOCUMENTS

| | | | |
|---|---|---|---|
| 2,389,376 | 11/1945 | Mandin | 83/587 |
| 3,154,992 | 11/1964 | Sahlin | 83/587 |
| 3,191,831 | 6/1965 | Bunting et al. | 83/587 X |
| 3,322,013 | 5/1967 | Felix | 83/575 X |
| 3,894,459 | 7/1975 | Deppe et al. | 83/586 |

FOREIGN PATENT DOCUMENTS

| | | | |
|---|---|---|---|
| 1,088,239 | 9/1960 | Germany | 83/586 |

*Primary Examiner*—Donald R. Schran
*Attorney, Agent, or Firm*—Craig & Antonelli

[57] ABSTRACT

A cutting arrangement for a filament monitoring system for use in a draw-twister and the like comprises a gripping member, a cutting member and an intermediate filament guide, all of which are mounted on a spring actuated slide. Actuation of the slide causes the gripping member and cutting member to grip and cut the filament, the filament guide maintaining the filament in proper position.

35 Claims, 5 Drawing Figures

CUTTING ARRANGEMENT

BACKGROUND OF THE INVENTION

This invention relates to a high-performance cutting arrangement for filament monitoring systems, particularly but not exclusively for use in draw-twisting machines, texturing machines and the like.

Conventional monitoring systems for draw-twisting machines, texturing machines and the like, comprise cutting units in which the filament to be cut is guided past a cutting blade between two guide members, gripping means for holding the cut end of the filament being provided immediately adjacent the cutting blade. In arrangements of this kind, the cutting blade and the gripping edge come into contact with an abutment under the action of an electromagnet activated by the cutting pulse. Although arrangements of this kind are adequate for fine and medium filaments in particular, they require large and expensive magnets to increase their performance, i.e, for treating thick and correspondingly strong filaments.

SUMMARY OF THE INVENTION

The present invention relates to a high-performance cutting arrangement for filament monitoring systems, particularly for use in draw-twisting machines, texturing machines and the like, which comprises a slide on which a filament guide is arranged in such a way that the filament travels between cutting and gripping edges on the one hand and their abutments on the other hand, the cutting blade being arranged with its abutment on one side of the filament guide, and the gripping edge being arranged with its abutment on the other side of the filament guide.

More specifically, the present invention provides a cutting arrangement for filament monitoring systems comprising a slide, a filament guide mounted on the slide; gripping means responsive to movement of the slide for gripping the filament arranged on one side of the filament guide and cutting means responsive to movement of the slide for cutting the filament arranged on another side of the filament guide.

In one advantageous embodiment of the invention, the cutting blade and gripping edge are mounted in the slide which provides on the one hand for replacement of the elements and, on the other hand, for an arrangement adapted to the various possible directions of filament travel. In addition, the abutment is in the form of a piece of U-shaped metal with symmetrical sides which can be inserted in at least two different positions, so that the cutting blade can strike several surfaces of the abutment before it has to be replaced.

The impact force required for cutting and gripping is taken from a power store, while the cutting pulse is responsible solely for releasing the power store. Thus, it is possible to obtain strong cutting forces and long strokes for the slide with relatively little outlay in terms of control systems.

Since the slide is returned to its starting position and, at the same time, the power store placed under tension, for example, by hand, there is no need for correspondingly powerful magnets.

BRIEF DESCRIPTION OF THE DRAWINGS

One embodiment of the invention will now be described by way of example in the following with reference to the accompanying drawings, wherein.

DETAILED DESCRIPTION

Figure 1:
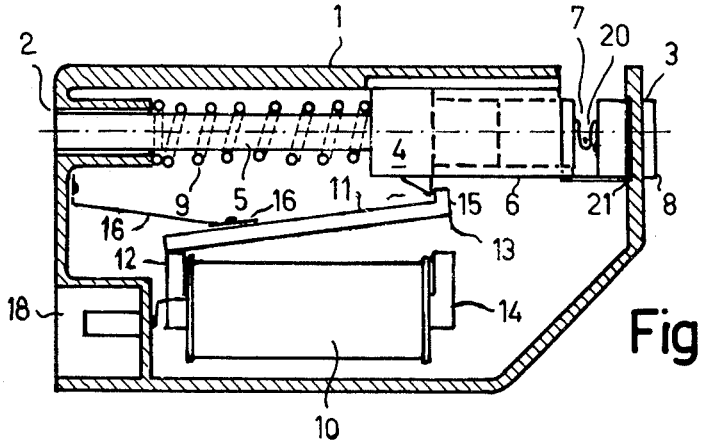
FIG. 1 is a side elevation, partly in section, of a cutting arrangement in accordance with the present invention in its starting position.
Figure 2:
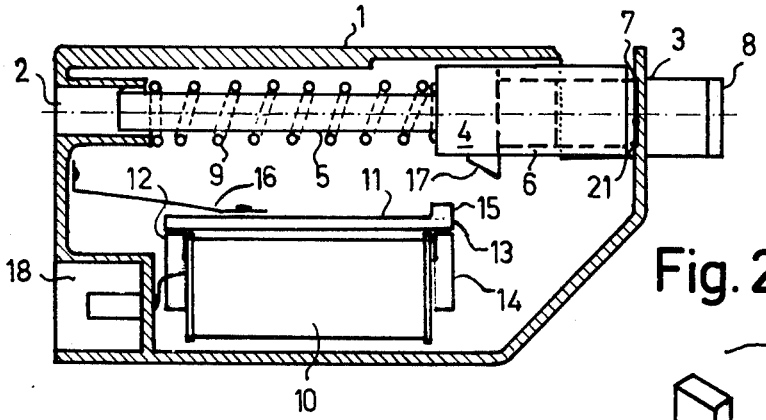
FIG. 2 is a side elevation in section of the same cutting arrangement on completion of the cutting operation.

In the arrangement shown in FIG. 1, a slide 4 is mounted in corresponding guide openings 2, 3 in a housing 1. The slide includes in longitudinal order a bolt 5, a blade holder 6, a filament guide 7 and a return button 8. A spring 9 is fitted over the bolt 5. One end of the spring 9 is supported by the housing 1 and its other end rests on the blade holder 6, pressing the slide 4 towards the right of the drawing. Actuating means comprising an electromagnet 10, for example a hinged armature magnet, is built into the lower part of the housing 1. The armature of this magnet is mounted on a yoke plate 12, while its end 13 forms the pole face against the yoke 14. The armature 11 is held in its rest position and applied to the yoke plate 12 by a leaf spring 16. The armature 11 has a projection 15 which co-operates with a nose-like projection 17 on the slide 4 in such a way that, when the slide 4 is pressed to the left of the drawing, the projection 15 of the armature 11 swinging upwards under spring pressure engages behind the aforementioned nose-like projection 17 and, hence, holds the slide 4 firmly against the thrust of the compressed spring 9. If an electrical cutting pulse is then applied through a plug and socket 18 to the winding of the electromagnet 10, the armature 11 is drawn against the yoke 14, so that the projection or latch 15 releases the nose 17. As a result the slide 4 is urged to the right by the compressed spring 9.

The cutting operation is initiated as follows:

The filament 20 travelling through in the filament guide 7 is brought up to the abutment 21. A cutting blade 22 is accommodated in the blade holder 6 (in front of the filament guide 7 looking in the direction of travel of the filament 20), striking a component surface of the abutment 21, and hence, cutting the filament 20 with the movement of the slide 4.

Figure 3:
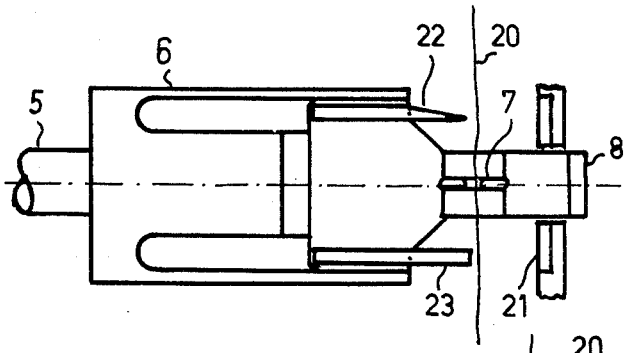
FIG. 3 is a plan view of those parts of the cutting arrangement actually involved in cutting in their starting position.
Figure 4:
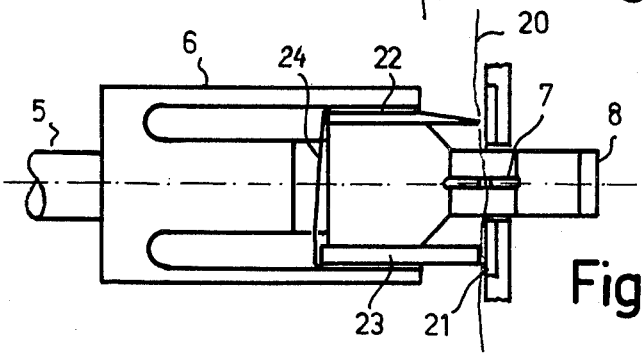
FIG. 4 is a plan view of the same parts of the cutting arrangement in their end positions.

In addition, the blade holder 6 accommodates a gripping member or edge 23 (after the filament guide 7 looking in the direction of travel of the filament 20) which grips the filament between its end face and another component surface of the abutment 21, gripping edge 23 and the component surface of abutment 21 thereby forming gripping means. The end face of the gripping edge 23 comes into contact with the abutment 21 somewhat earlier than the cutting edge of the cutting blade 22, so that the filament 20 is first gripped and then cut. The difference in the distance travelled by the gripping member or edge 23 and the cutting blade 22 is compensated by virtue of the fact that the gripping edge 23 is mounted for displacement in the blade holder 6 and is kept in its rest position under gentle spring pressure (spring 24). FIGS. 3 and 4 show the blade holder 6 with the filament guide 7, the reset button, the cutting blade 22 and the gripping edge 23 before and after release, respectively.

Figure 5:
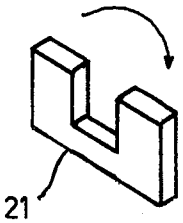
FIG. 5 shows a structural detail.

FIG. 5 shows, as a structural detail, the configuration of the abutment 21 in the form of a piece of U-shaped metal which can be inserted into a corresponding opening in the housing 1. Because of its symmetrical configuration, it can be inserted in two different positions. In this way, it is possible, in the event of increasing wear of the surfaces exposed to the action of the cutting blade and gripping edge, for another, intact component surface to be moved into the cutting and gripping zone.

As the filament guide 7 is only laterally displaced with the slide 4 when the cut is made, the filament 20 does not come into contact with the cutting and gripping surfaces in its normal travel, so that premature wear of those surfaces is avoided. In addition, there is enough empty space on either side of the filament guide 7 for fibers accumulating in that space to be removed before accumulating to such an extent that they interfere with the movement of the slide 4. The filament guide 7, may in addition, be provided with double guide slots to enable two separate filaments to be cut and gripped.

The use of the spring 9 for taking over the cutting work and supplying the gripping force has the effect that high cutting performances are obtained with minimal consumption of electricity. In addition, the gripping force remains intact even after the electrical cutting pulse has disappeared. By suitably dimensioning the leverage factors, the leaf spring 16 and the spring 9, the self-holding effect provided by the projection 15 and the nose 17 can be made so sensitive that it only needs a minimal force to swing the projection 15 away from the nose 17. In this way, it is also possible, where necessary, for the cutting arrangement to be manually operated by the application of an additional pressure from outside to the bolt 5.

In order to return the slide 4 to its starting position, it is sufficient to depress the reset button 8, which compresses the spring 9 until the projection 15 engages behind the nose 17 on the slide 4. The particular operational state can readily be ascertained at any time, for example from the projecting position of the reset button 8 on completion of cutting.

The blade holder 6 may with advantage be symmetrical with respect to the central axis of the slide 4, so that the cutting blade 22 may readily be inserted to the left or right and the gripping edge 23 to the right or left. As a result, the cutting arrangement is not affected by the direction of travel of the filament 20. The arrangement as a whole is compact in its design with small external dimensions, so that it may be used for every possible application.

Although only a single embodiment has been described above, it should be appreciated that many modifications can be made without departing from the spirit and scope of the present invention. All such modifications are intended to be included within the scope of the present invention which is to be limited only by the following claims.

What is claimed is:

1. A cutting arrangement for filament monitoring systems comprising; a slide; means for moving said slide; a filament guide on said slide; gripping means responsive to movement of said slide for gripping said filament arranged on one side of said filament guide; and cutting means responsive to movement of said slide for cutting said filament arranged on another side of said filament guide.

2. The cutting arrangement of claim 1, wherein the gripping means is resiliently mounted in the slide such that said gripping means comes into contact with an abutment anvil earlier than the cutting means.

3. The cutting arrangement of claim 1, wherein the cutting means and gripping means are replaceably mounted in the slide, so that the cutting arrangement can be adjusted to the direction of travel of the filament.

4. The cutting arrangement of claim 1, further comprising a housing, an abutment for the cutting means and an abutment for the gripping means being an integral abutment member, the housing having an opening for receiving the abutment member in one of at least two positions so that different surfaces of said abutment member are exposed to the cutting means and gripping means.

5. The cutting arrangement of claim 1, wherein the filament guide is an insert formed with two guide grooves.

6. The cutting arrangement of claim 1, wherein at least one of a projecting reset button and a bolt is provided for indicating the position of the slide.

7. The cutting arrangement of claim 1, wherein said gripping means includes a gripping member mounted on said slide and first abutment means for abutting said gripping member upon movement of said slide.

8. The cutting arrangement of claim 7, wherein said cutting means includes a cutting blade mounted on said slide and second abutment means for abutting said cutting blade upon movement of said slide.

9. The cutting arrangement of claim 8, wherein said slide is moveable between a first position in which said filament is free to travel through said filament guide, said gripping means and said cutting means and a second position in which said filament is gripped by said gripping means and cut by said cutting means.

10. The cutting arrangement of claim 9, wherein said slide moves from said first position to said second position laterally with respect to the direction of travel of said filament through said cutting arrangement.

11. The cutting arrangement of claim 10, wherein said gripping member is arranged on said slide forward of said cutting blade so that said gripping member grips said filament before said cutting blade cuts said filament.

12. The cutting arrangement of claim 11, wherein said cutting means is arranged upstream of said gripping means with respect to the direction of travel of said filament.

13. The cutting arrangement of claim 10, wherein said cutting means is arranged upstream of said gripping means with respect to the direction of travel of said filament.

14. The cutting arrangement of claim 9, further comprising biasing means biasing said slide towards said second position and latch means retaining said slide in said first position.

15. The cutting arrangement of claim 14, further comprising actuating means for releasing said latch so that said biasing means can move said slide from said first position to said second position.

16. The cutting arrangement of claim 15, wherein said biasing means is a mechanical biasing means.

17. The cutting arrangement of claim 16, wherein said mechanical biasing means is a spring.

18. The cutting arrangement of claim 14, wherein said biasing means is a mechanical biasing means.

19. The cutting arrangement of claim 18, wherein said mechanical biasing means is a spring.

20. The cutting arrangement of claim 19, wherein said slide moves from said first position to said second position laterally with respect to the direction of travel of said filament through said cutting arrangement.

21. The cutting arrangement of claim 20, wherein said gripping member is arranged on said slide forward of said cutting blade so that said gripping member grips said filament before said cutting blade cuts said filament.

22. The cutting arrangement of claim 21 wherein said cutting means is arranged upstream of said gripping means with respect to the direction of travel of said filament.

23. The cutting arrangement of claim 20, wherein said cutting means is arranged upstream of said gripping means with respect to the direction of travel of said filament.

24. The cutting arrangement of claim 10, wherein said filament guide is fixedly mounted on said slide such that said filament guide moves said filament laterally with respect to the direction of travel of said filament through said cutting arrangement as said slide moves from said first position to said second position.

25. The arrangement of claim 24, further comprising mechanical biasing means biasing said slide towards said second position and latch means retaining said slide in said first position.

26. The arrangement of claim 25, further comprising actuating means for releasing said latch so that said mechanical biasing means can move said slide from said first position to said second position.

27. The arrangement of claim 26, wherein said mechanical biasing means is a spring.

28. The arrangement of claim 24, further comprising housing means mounting said slide and fixedly mounting said first abutment means and second abutment means.

29. The cutting arrangement of claim 28, wherein said first abutment means and said second abutment means are integral.

30. The cutting arrangement of claim 1, wherein said slide is movable between a first position in which said filament is free to travel through said filament guide, said gripping means and said cutting means and a second position in which said filament is gripped by said gripping means and cut by said cutting means.

31. The cutting arrangement of claim 30, wherein said filament guide is fixedly mounted on said slide such that said filament guide laterally moves said filament with respect to the direction of travel of said filament through said cutting arrangement as said slide moves from said first position to said second position.

32. The cutting arrangement of claim 31, further comprising a compression spring for moving said slide between said first position and said second position.

33. the cutting arrangement of claim 1, wherein the filament guide continuously guides the filament in its travel through the cutting arrangement.

34. A cutting arrangement for filament monitoring systems, for use in draw-twisting machines, texturing machines and the like, comprising a housing having an opening through which a filament travels, a slide member mounted for movement in a direction transverse to the travel direction of the filament, said slide member being provided with a cutting blade and a gripping member spaced from one another, said cutting blade and said gripping member being mounted for movement with said slide member against associated abutment portions, said gripping member being mounted for contacting its abutment portion earlier than the cutting blade contacts its abutment portion such that the filament traveling through the opening of said housing is first gripped by said gripping member and is then cut by said cutting member.

35. The cutting arrangement of claim 34, wherein said slide member is further provided with a filament guide positioned between said cutting blade and gripping member for continuously guiding the filament in its travel through the opening of said housing.

* * * * *